US006840415B1

(12) United States Patent
Sapien, Jr.

(10) Patent No.: US 6,840,415 B1
(45) Date of Patent: Jan. 11, 2005

(54) BRACE ASSEMBLY FOR SUPPORTING A DRYWALL PAN

(76) Inventor: Eddie Sapien, Jr., 189 N. Oak Glen, Niporno, CA (US) 93444

( * ) Notice: Subject to any disclaimer, the term of this patent is extended or adjusted under 35 U.S.C. 154(b) by 649 days.

(21) Appl. No.: 10/028,559

(22) Filed: Oct. 25, 2001

(51) Int. Cl.[7] ..... A45F 5/00

(52) U.S. Cl. ..... 224/221; 224/267; 224/270; 294/3.5; 294/25; 294/26; 294/26.5; 294/32

(58) Field of Search ..... 224/218–222, 224/267, 270–272; 294/3.5, 25, 26, 26.5, 32, 144, 172; 108/43, 50.14; 248/444; 623/61

(56) References Cited

U.S. PATENT DOCUMENTS 1,428,285 A * 9/1922 Herbert ..... 224/270
5,031,323 A * 7/1991 Honsa et al. ..... 30/276
5,052,603 A * 10/1991 Spina ..... 224/270
5,261,581 A * 11/1993 Harden, Sr. ..... 224/219
5,601,356 A * 2/1997 McWilliams ..... 224/221
5,769,264 A * 6/1998 Lipkowitz ..... 294/144
5,775,770 A * 7/1998 Tunney ..... 297/183.1
5,806,709 A * 9/1998 Marshall, II ..... 294/32
6,394,516 B1 * 5/2002 Zhuravsky ..... 224/218
6,726,070 B2 * 4/2004 Lautner ..... 224/221
2002/0047028 A1 * 4/2002 Harada et al. ..... 224/219
2003/0019894 A1 * 1/2003 Caldana ..... 224/219

* cited by examiner

*Primary Examiner*—Nathan J. Newhouse
(74) *Attorney, Agent, or Firm*—Goldstein Law Offices, P.

(57) ABSTRACT

A brace assembly for supporting a drywall pan including a support frame positionable within a user's hand adapted for holding a drywall pan. An arm and wrist brace is adapted for being secured to a user's arm and wrist. A connection brace extends between the support frame and the arm and wrist brace.

7 Claims, 2 Drawing Sheets

BRACE ASSEMBLY FOR SUPPORTING A DRYWALL PAN

BACKGROUND OF THE INVENTION

The present invention relates to a brace assembly for supporting a drywall pan and more particularly pertains to assisting a drywaller by relieving stress on his or her wrist and hand normally associated with holding a drywall pan.

The use of drywall tools and accessories is known in the prior art. More specifically, drywall tools and accessories heretofore devised and utilized for the purpose of aiding drywallers are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,261,584 to Albert discloses a mud pan capable of being attached to the belt of a worker during drywall installation. U.S. Pat. No. 5,553,348 to Brandenburger discloses a storage device for drywall texturing material. U.S. Pat. No. 5,736,001 to Samuelson discloses a combination joint compound hopper and tape dispenser.

While these devices fulfill their respective, particular objective and requirements, the aforementioned patents do not describe a brace assembly for supporting a drywall pan for assisting a drywaller by relieving stress on his or her wrist and hand normally associated with holding a drywall pan.

In this respect, the brace assembly for supporting a drywall pan according to the present invention substantially departs from the conventional concepts and designs of the prior art, and in doing so provides an apparatus primarily developed for the purpose of assisting a drywaller by relieving stress on his or her wrist and hand normally associated with holding a drywall pan.

Therefore, it can be appreciated that there exists a continuing need for a new and improved brace assembly for supporting a drywall pan which can be used for assisting a drywaller by relieving stress on his or her wrist and hand normally associated with holding a drywall pan. In this regard, the present invention substantially fulfills this need.

SUMMARY OF THE INVENTION

In the view of the foregoing disadvantages inherent in the known types of drywall tools and accessories now present in the prior art, the present invention provides an improved brace assembly for supporting a drywall pan. As such, the general purpose of the present invention, which will be described subsequently in greater detail, is to provide a new and improved brace assembly for supporting a drywall pan which has all the advantages of the prior art and none of the disadvantages.

To attain this, the present invention essentially comprises a support frame positionable within a user's hand adapted for holding a drywall pan. The support frame includes a pair of parallel horizontal members having opposed edges, and a pair of side members extending between the opposed edges of the horizontal members. The side members each have a base portion and opposed ends, the base portion positioned below the horizontal members and the opposed ends extending upwardly from the base portion at an upward angle to meet the horizontal member edges. An arm and wrist brace is adapted for being secured to a user's arm and wrist. The brace includes a pair of elongated supports receiving the arm and wrist therebetween. The brace includes an upper arcuate wrist support extending between upper ends of the elongated supports. The brace includes a lower arcuate arm support extending between lower ends of the elongated supports. The arm and wrist brace includes adjustable straps for coupling with the user's arm and wrist. A connection brace extends between the support frame and the arm and wrist brace. The connection brace has a first end fixedly secured to the horizontal member closest to the arm and wrist brace and a second end pivotally coupled with the upper arcuate wrist support of the arm and wrist brace.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved brace assembly for supporting a drywall pan which has all the advantages of the prior art drywall tools and accessories and none of the disadvantages.

It is another object of the present invention to provide a new and improved brace assembly for supporting a drywall pan which may be easily and efficiently manufactured and marketed.

It is a further object of the present invention to provide a new and improved brace assembly for supporting a drywall pan which is of durable and reliable construction.

An even further object of the present invention is to provide a new and improved brace assembly for supporting a drywall pan which is susceptible of a low cost of manufacture with regard to both materials and labor, and which accordingly is then susceptible of low prices of sale to the consuming public, thereby making such a brace assembly for supporting a drywall pan economically available to the buying public.

Even still another object of the present invention is to provide a new and improved brace assembly for supporting a drywall pan for assisting a drywaller by relieving stress on his or her wrist and hand normally associated with holding a drywall pan.

Lastly, it is an object of the present invention to provide a new and improved brace assembly for supporting a drywall pan including a support frame positionable within a user's hand adapted for holding a drywall pan. An arm and wrist brace is adapted for being secured to a user's arm and wrist. A connection brace extends between the support frame and the arm and wrist brace.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
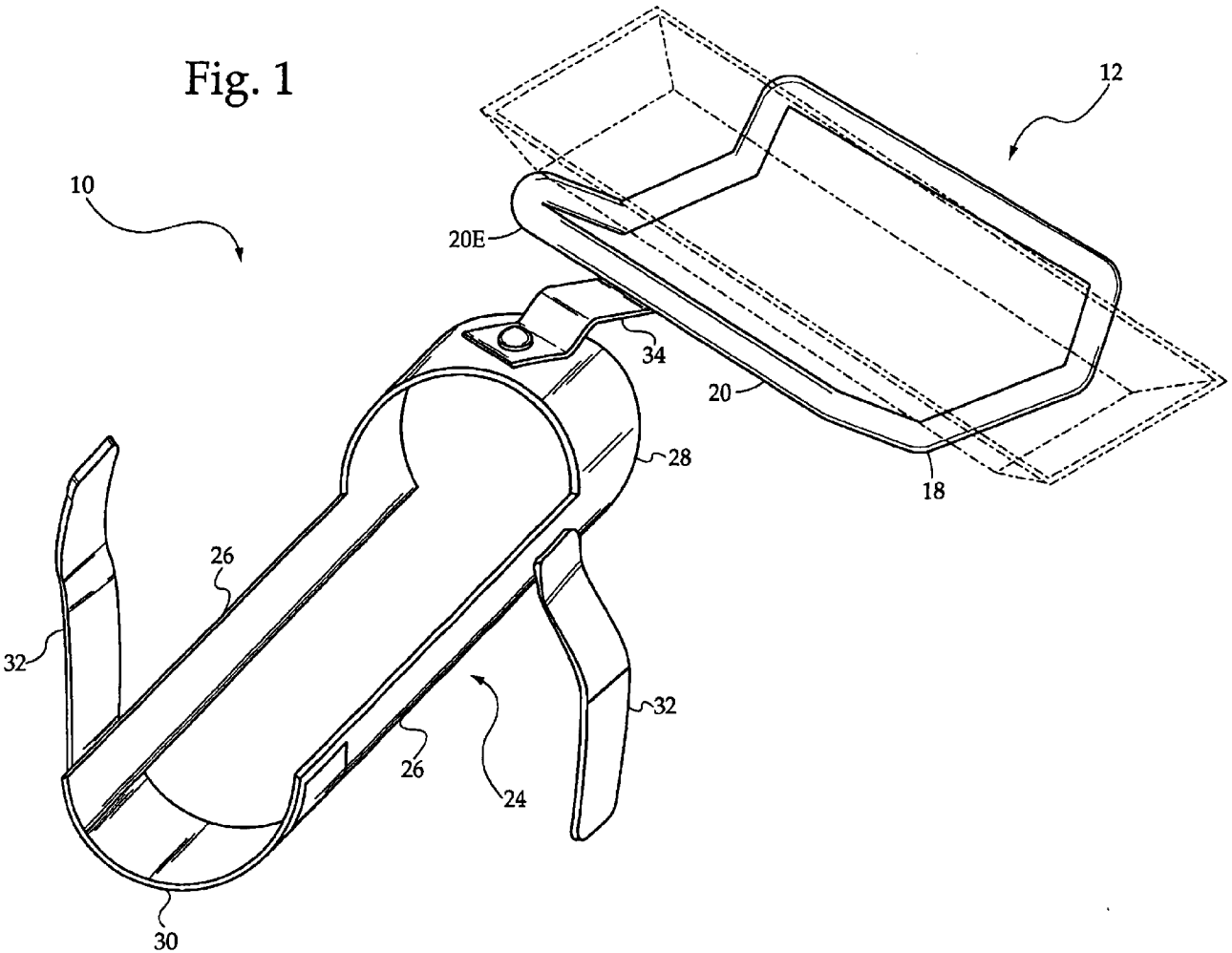
FIG. 1 is a perspective view of the preferred embodiment of the brace assembly for supporting a drywall pan constructed in accordance with the principles of the present invention.
Figure 2:
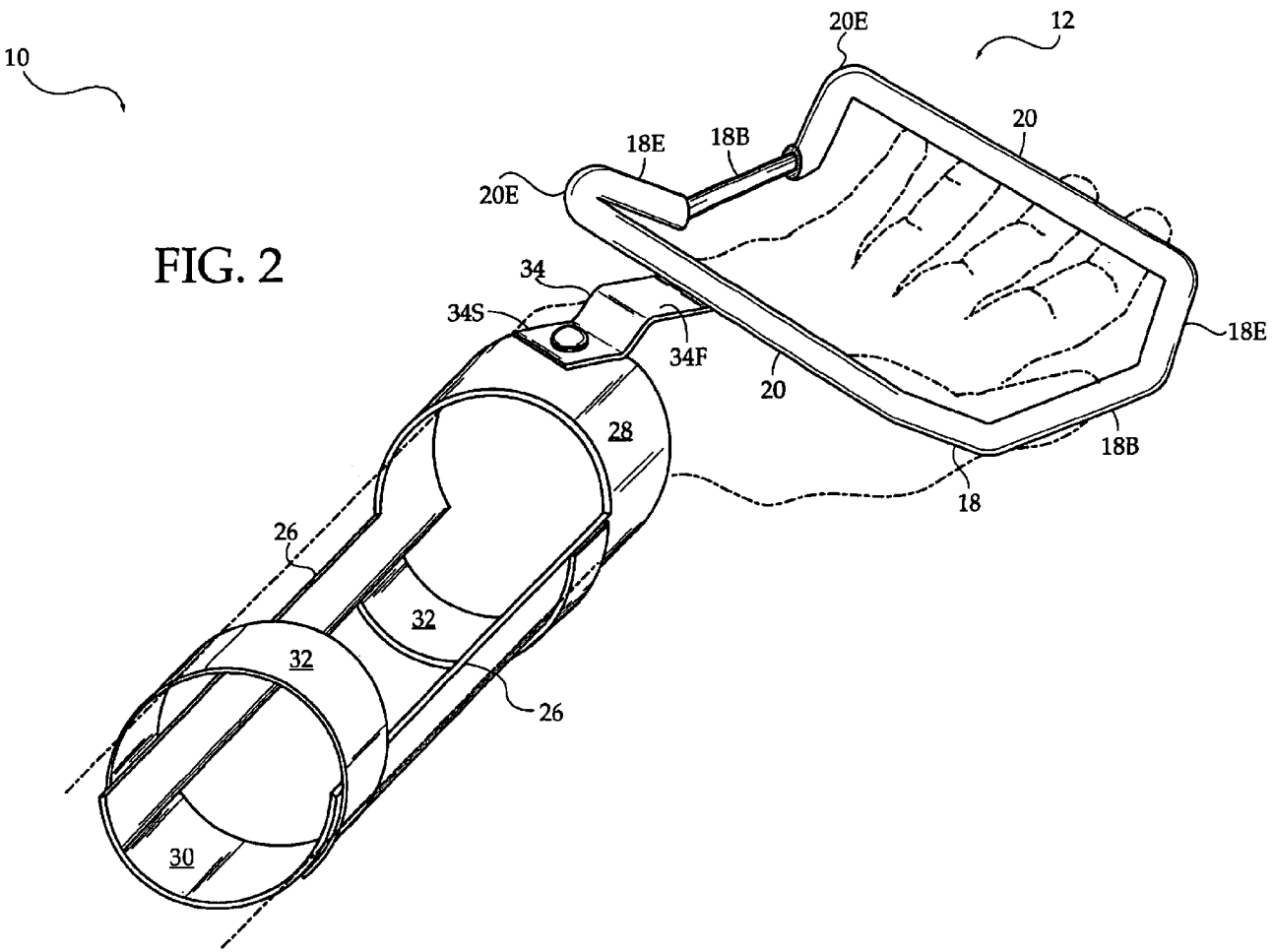
FIG. 2 is a perspective view of the present invention illustrated in use.

With reference now to the drawings, and in particular, to FIGS. 1 and 2 thereof, the preferred embodiment of the new and improved brace assembly for supporting a drywall pan embodying the principles and concepts of the present invention and generally designated by the reference number 10 will be described.

Specifically, it will be noted in the various Figures that the device relates to a brace assembly for supporting a drywall pan for assisting a drywaller by relieving stress on his or her wrist and hand normally associated with holding a drywall pan. In its broadest context, the device consists of a support frame, an arm and wrist brace, and a connection brace. Such components are individually configured and correlated with respect to each other so as to attain the desired objective.

The support frame 12 is positionable within a user's hand 14 and is adapted for holding a drywall pan 16. The support frame 12 includes a pair of horizontal members 20 that are substantially parallel to each other, said members having opposed edges 20E. Side members 18 extend between the opposed edges of the horizontal members 20. The side members 18 have a base portion 18B and opposed ends 18E, the base portion 18B positioned below the opposed edges 20E of the horizontal members 20. The opposed ends 18E of the side members 18 extend upward from the base portion 18B at an upward angle to meet the horizontal member edges 20E. The entire support frame 12 has a rubber covering, as illustrated in FIG. 2, to prevent the drywall pan 16 from sliding or slipping when positioned in the frame 12 during use.

The arm and wrist brace 24 is adapted for being secured to a user's-arm and wrist. The brace 24 includes a pair of elongated supports 26 receiving the arm and wrist therebetween. The brace 24 includes an upper arcuate wrist support 28 extending between upper ends of the elongated supports 26. The brace 24 includes a lower arcuate arm support 30 extending between lower ends of the elongated supports 26. In use, the wrist support 28 will be disposed on top of the wrist while the arm support 30 will be disposed below the arm, as illustrated in FIG. 2. The arm and wrist brace 24 includes adjustable straps 32 for coupling with the user's arm and wrist. In the preferred embodiment, the adjustable straps 32 will be positioned with respect to the wrist support 28 and the arm support 30. This will allow complete enclosures around the wrist and arm of the user. Note FIG. 2.

A connection brace 34 extends between the support frame 12 and the arm and wrist brace 24. The connection brace 34 has a first end 34F fixedly secured to the horizontal member 20 closest to the arm and wrist brace 24 and a second end 34S pivotally coupled with the upper arcuate wrist support 28 of the arm and wrist brace 24. The connection brace 34 is contoured upward toward the support frame 12 in order to accommodate a user's wrist. The connection brace 34 will allow the user to turn his or her wrist in a normal manner while utilizing the present invention. Thus, the connection brace 34 will not limit the movement of the user's wrist during the drywall process.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents way be resorted to, falling within the scope of the invention.

What is claimed as being new and desired to be protected by Letters Patent of the United States is as follows:

1. A brace assembly for supporting a drywall pan for assisting a drywaller by relieving stress on his or her wrist and hand normally associated with holding a drywall pan comprising, in combination:

a support frame, having a rubber coating, positionable within a user's hand adapted for holding a drywall pan, the support frame including a pair of horizontal members having opposed edges, said members being parallel, and a pair of side members extending between the opposed edges of the horizontal members, said side members each having a base portion and opposed ends, the base portion positioned below the horizontal members and the opposed ends extending upwardly from the base portion at an upward angle to meet the horizontal member edges;

an arm and wrist brace adapted for being secured to a user's arm and wrist, the brace including a pair of elongated supports receiving the arm and wrist therebetween, the brace including an upper arcuate wrist support extending between upper ends of the elongated supports, the brace including a lower arcuate arm support extending between lower ends of the elongated supports, the arm and wrist brace including adjustable straps for coupling with the user's arm and wrist; and a connection brace extending between the support frame and the arm and wrist brace, the connection brace having a first end fixedly secured to the support frame and a second end pivotally coupled with the upper arcuate wrist support of the arm and wrist brace, the connection brace being contoured upward towards the support frame.

2. A brace assembly for supporting a drywall pan for assisting a drywaller by relieving stress on his or her wrist and hand normally associated with holding a drywall pan comprising, in combination:

a support frame positionable within a user's hand adapted for holding a drywall pan, the support frame includes a pair of horizontal members having opposed edges, said members being parallel, and a pair of side members extending between the opposed edges of the horizontal members, said side members each having a base portion and opposed ends, the base portion positioned below the horizontal members and the opposed ends extending upwardly from the base portion at an upward angle to meet the horizontal member edges;

an arm and wrist brace adapted for being secured to a user's arm and wrist; and a connection brace extending between the support frame and the arm and wrist brace.

3. The brace assembly for supporting a drywall pan as set forth in claim 2, wherein the support frame has a rubber coating.

4. The brace assembly for supporting a drywall pan as set forth in claim 2, wherein the arm and wrist brace includes a pair of elongated supports receiving the arm and wrist therebetween, the brace including an upper arcuate wrist support extending between upper ends of the elongated supports, the brace including a lower arcuate arm support extending between lower ends of the elongated supports.

5. The brace assembly for supporting a drywall pan as set forth in claim 4, wherein the arm and wrist brace includes adjustable straps for coupling with the user's arm and wrist.

6. The brace assembly for supporting a drywall pan as set forth in claim 2, wherein the connection brace has a first end fixedly secured to the support frame and a second end pivotally coupled with the arm and wrist brace.

7. The brace assembly for supporting a drywall pan as set forth in claim 6, wherein the connection brace is contoured upward towards the support frame.

* * * * *